US010925385B2

(12) United States Patent
Lehar

(10) Patent No.: US 10,925,385 B2
(45) Date of Patent: Feb. 23, 2021

(54) CHILDREN'S FINGER TOOTHBRUSH WITH BITE PROTECTION AND TACTILE FEEDBACK

(71) Applicant: Nicole Lehar, Rock Springs, WY (US)

(72) Inventor: Nicole Lehar, Rock Springs, WY (US)

( * ) Notice: Subject to any disclaimer, the term of this patent is extended or adjusted under 35 U.S.C. 154(b) by 59 days.

(21) Appl. No.: 16/504,164

(22) Filed: Jul. 5, 2019

(65) Prior Publication Data

US 2020/0008565 A1 Jan. 9, 2020

Related U.S. Application Data

(60) Provisional application No. 62/694,673, filed on Jul. 6, 2018.

(51) Int. Cl.

| | |
|---|---|
| ***A46B 5/04*** | (2006.01) |
| ***A46B 1/00*** | (2006.01) |
| *A46B 5/02* | (2006.01) |

(52) U.S. Cl.

CPC ..... *A46B 5/04* (2013.01); *A46B 1/00* (2013.01); *A46B 5/023* (2013.01); *A46B 2200/1066* (2013.01)

(58) Field of Classification Search

CPC .. A46B 1/00; A46B 3/005; A46B 3/04; A46B 3/22; A46B 5/04; A46B 9/04; A61H 13/00

USPC ..... 15/167.1, 186–188, 227; 601/139, 141; 2/21

See application file for complete search history.

(56) References Cited

U.S. PATENT DOCUMENTS

| | | | | |
|---|---|---|---|---|
| 1,168,998 | A * | 1/1916 | Brandenburg | 15/167.1 |
| 6,237,148 | B1 * | 5/2001 | Graham | A41D 13/087 2/21 |
| 2016/0015161 | A1 * | 1/2016 | Mullen | A46B 1/00 433/216 |

FOREIGN PATENT DOCUMENTS

| | | | |
|---|---|---|---|
| GB | 398919 | * | 9/1933 |

* cited by examiner

*Primary Examiner* — Mark Spisich

(74) *Attorney, Agent, or Firm* — Dentons Durham Jones Pinegar; Sarah W. Matthews

(57) ABSTRACT

An outer elastomeric layer forms a nonogonal-shaped hollow tube for a finger toothbrush to be used by an adult caregiver to brush a child's teeth. The toothbrush has a first, rigid portion with a rigid inner lining configured to receive a middle phalange of the caregiver's finger and a second, flexible portion configured to receive a distal phalange of the caregiver's finger. The rigid inner lining may further comprise extensions and depressions to spread the pressure from a child's bite. The second, flexible portion may allow for better tactile response when the toothbrush is in the mouth of a child.

9 Claims, 5 Drawing Sheets

CHILDREN'S FINGER TOOTHBRUSH WITH BITE PROTECTION AND TACTILE FEEDBACK

CROSS REFERENCE TO RELATED APPLICATION

This application claims the priority benefit of U.S. Provisional Application No. 62/694,673 filed Jul. 6, 2018.

TECHNICAL FIELD

The present invention relates generally to a finger toothbrush for an adult to place on their finger to brush a child's teeth. More specifically, the present invention relates to an improved finger toothbrush with a rigid portion and a flexible portion to allow tactile feedback and protection for the adult's finger.

BACKGROUND

Past developments in finger mounted toothbrushes have varied greatly in design. Teeth cleaning applicators which are finger manipulated are known, and there are numerous patents disclosing devices designed for brushing and cleaning of teeth. For example, some of these devices have been developed for placement on and surrounding at least a finger portion. When it is desired to brush the teeth of an individual, the device is mounted onto the finger. In the case of a caregiver brushing a child's teeth, the device is mounted onto the finger of the caregiver and used to brush the child's teeth. Such fingertip toothbrushes for use on children's teeth typically are formed or a soft elastomer, such as silicon.

However, when brushing a child's teeth, the child may be disposed to bite down (due to a bite reflex or otherwise) on the finger mounted toothbrush. Depending on the size of the child and the strength of their bite, this can cause harm to the caregiver's finger if an elastomer fingertip toothbrush is used. A rigid fingertip toothbrush may provide additional protection for the caregiver's finger, but such rigid devices do not allow for the tactile feedback that is present with elastomer fingertip toothbrushes. Tactile feedback is important so the caregiver may be able to tell where their finger is in relation to the child's teeth.

Thus, there is a need for a finger toothbrush which provides protection to the caregiver's finger, while also allowing for tactile feedback so the caregiver may adequately brush the child's teeth. It may also be advantageous if the toothbrush may be formed from a simple construction.

SUMMARY OF INVENTION

A children's fingertip toothbrush may include: an outer elastomeric layer forming hollow tube, the hollow tube comprising a first, open end and a second, closed end, the hollow tube having a first rigid portion proximal to the first, open end, and a second flexible portion proximal to the second, closed end. The first rigid portion may be configured to receive a middle phalange of a caregiver's finger and the second flexible portion may be configured to receive a distal phalange of the caregiver's finger. In some configurations, the first rigid portion may be configured to receive a portion of the middle phalange of a caregiver's finger and a portion of a distal phalange, with the second flexible portion configured to receive the distal portion of the distal phalange of the caregiver's finder.

According to another aspect, the outer elastomeric layer comprises an interior and an exterior. In some configurations, the first rigid portion comprises a rigid lining, the rigid lining having an inner face and an outer face, and the outer face of the rigid lining being connected to the interior of the outer elastomeric layer proximal to the first rigid portion. A plurality of bristles may be connected to the exterior of the nonogonal-shaped hollow tube proximal to the second flexible portion.

According to another aspect, the inner face of the rigid lining may have a surface comprised of a plurality of extensions and depressions. Such extensions and depressions may spread pressure from a child's bite over the caregiver's finger.

According to yet another aspect, the hollow tube may comprise a nonogonal-shaped hollow tube.

In accordance with one aspect of the disclosure, a method is provided to form a fingertip toothbrush having a first substantially rigid portion and a second substantially flexible portion.

BRIEF DESCRIPTION OF DRAWINGS

The following drawings illustrate what are currently considered to be specific representative configurations for carrying out the invention and are not limiting as to embodiments which may be made in accordance with the present invention. The components in the drawings are not necessarily to scale relative to each other. Like reference numerals designate corresponding parts throughout the several views.

The drawings are illustrative and not limiting of the scope of the invention which is defined by the appended claims. The various elements of the invention accomplish various aspects and objects of the invention. Not every element of the invention can be clearly displayed in a single drawing, and as such not every drawing shows each element of the invention.

DETAILED DESCRIPTION

Figure 1:
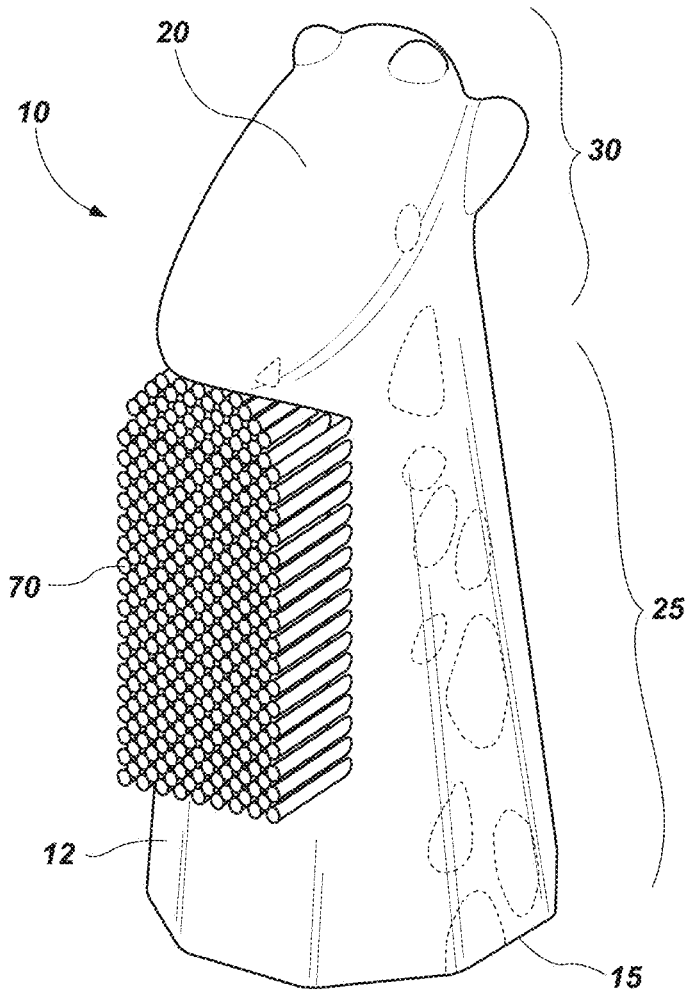
FIG. 1 is a perspective view of a fingertip toothbrush.
Figure 2:
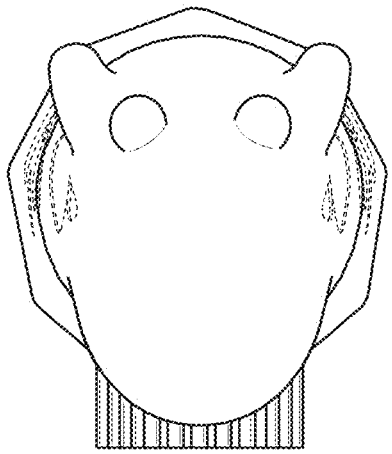
FIG. 2 is a top view of the fingertip toothbrush of FIG. 1.
Figure 3:
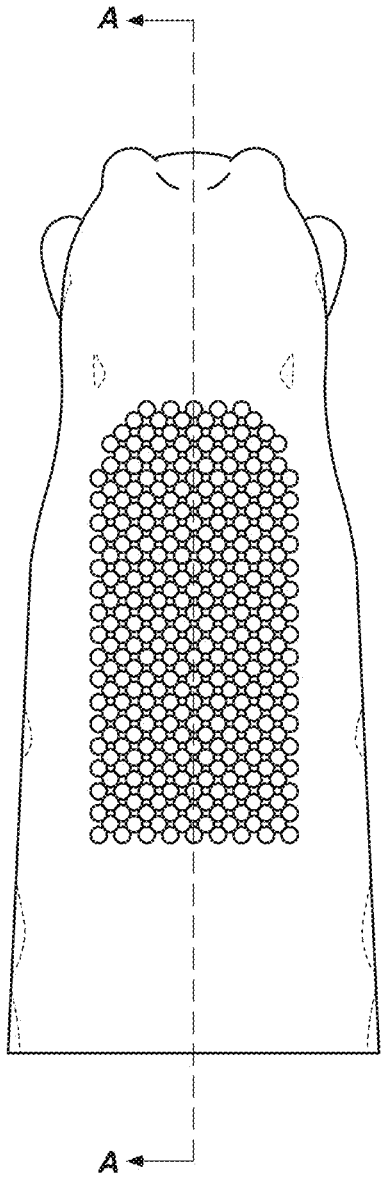
FIG. 3 is a front view of the fingertip toothbrush of FIG. 1.
Figure 4:
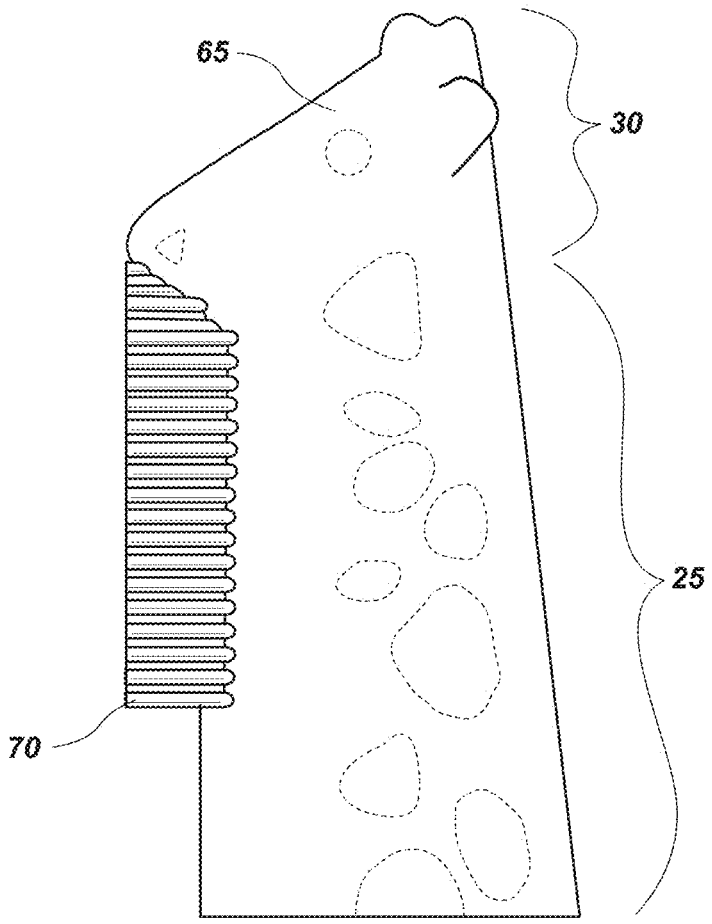
FIG. 4 is a side view of the fingertip toothbrush of FIG. 1.
Figure 5:
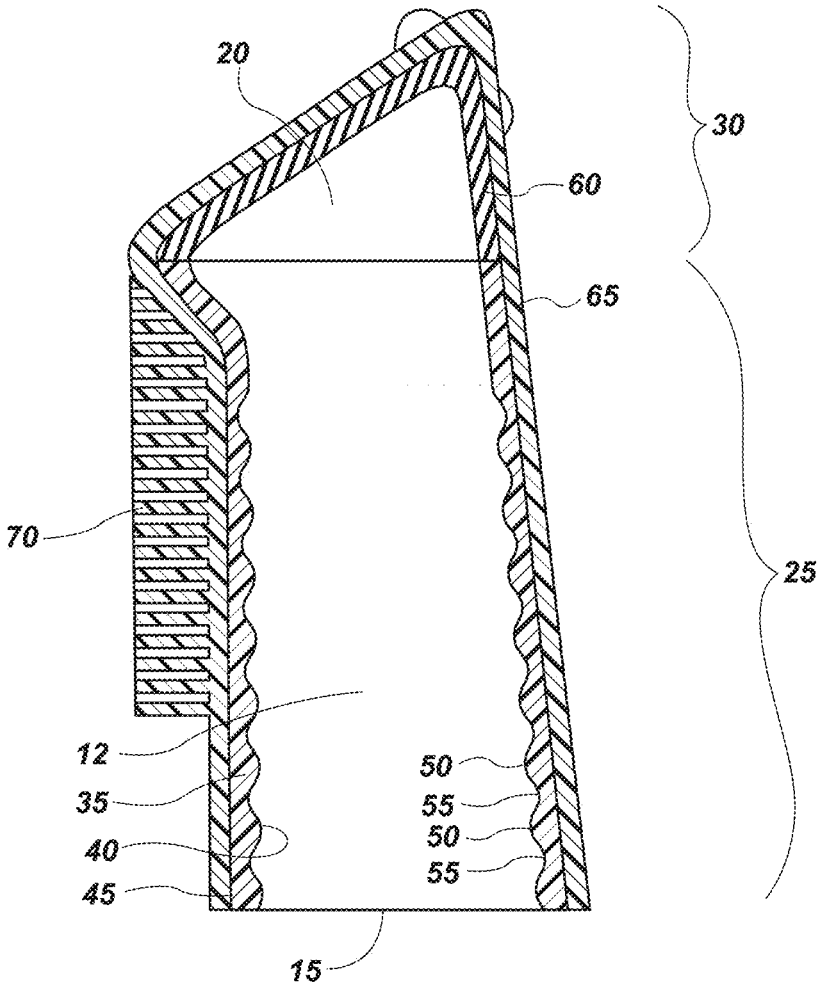
FIG. 5 is a cross-sectional view of the fingertip toothbrush taken along line A-A of FIG. 3.

The following provides a detailed description of particular embodiments of the present invention. Reference will now be made to the drawings in which the various elements of the illustrated configurations will be given numerical designations and in which the invention will be discussed so as to enable one skilled in the art to make and use the invention. It is to be understood that the following description is only exemplary of the principles of the present invention, and should not be viewed as narrowing the scope of the claims which follow, which claims define the full scope of the invention.

It will be appreciated that various aspects discussed in one drawing may be present and/or used in conjunction with the embodiment shown in another drawing, and each element shown in multiple drawings may be discussed only once. For example, in some cases, detailed description of well-known items or repeated description of substantially the same configurations may be omitted. The reason is to facilitate the understanding of those skilled in the art by avoiding the following description from being unnecessarily redundant. The accompanying drawings and the following description are provided in order for those skilled in the art to fully understand the present disclosure, and these are not intended to limit the gist disclosed in the scope of claims.

It should be noted that the description merely illustrates the principles of the present subject matter. It will thus be appreciated that those skilled in the art will be able to devise various arrangements that, although not explicitly described herein, embody the principles of the present subject matter and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

Reference in the specification to "one configuration" "one embodiment," "a configuration" or "an embodiment" means that a particular feature, structure, or characteristic described in connection with the configuration is included in at least one configuration, but is not a requirement that such feature, structure or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

Furthermore, the described features, structures, or characteristics of configurations of the invention may be combined in any suitable manner in one or more configurations. In the following description, numerous specific details are provided, such as examples of products or manufacturing techniques that may be used, to provide a thorough understanding of configurations of the invention. One skilled in the relevant art will recognize, however, that configurations of the invention may be practiced without one or more of the specific details, or with other methods, components, materials, and so forth. In other instances, well-known structures, materials, or operations are not shown or described in detail to avoid obscuring aspects of the invention.

Before the present invention is disclosed and described in detail, it should be understood that the present disclosure is not limited to any particular structures, process steps, or materials discussed or disclosed herein, but is extended to include equivalents thereof as would be recognized by those of ordinary skill in the relevant art. More specifically, the invention is defined by the terms set forth in the claims. It should also be understood that terminology contained herein is used for the purpose of describing particular aspects of the invention only and is not intended to limit the invention to the aspects or configurations shown unless expressly indicated as such. Likewise, the discussion of any particular aspect of the invention is not to be understood as a requirement that such aspect is required to be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a wheel" may include one or more of such wheels, and reference to "the spring" may include reference to one or more of such springs.

As used herein, the term "substantially" refers to the complete or nearly complete extent or degree of an action, characteristic, property, state, structure, item, or result to function as indicated. For example, an object, such as a spring, that is "substantially" enclosed would mean that the object is either completely enclosed or nearly completely enclosed. The exact allowable degree of deviation from absolute completeness may in some cases depend on the specific context, such that enclosing nearly all of the spring would be substantially enclosed, even if the distal end of the structure enclosing the clamp had a slit or opening formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it lacked a bottom.

As used herein the term "generally" refers to something that is more of the designated adjective than not, or the converse if used in the negative. For example, something maybe said to be generally circular even though it has a somewhat oval shape or is polygonal rather than being completely smooth.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

As used herein, "interior" refers to a portion of the toothbrush configured to receive a finger of a caregiver, while "exterior" refers to the side opposite the interior.

The present invention generally relates to a toothbrush for an adult caregiver to use while brushing a child's teeth. One particular embodiment of the present invention is shown and described in a children's fingertip toothbrush of FIGS. 1-6. FIG. 1 is a perspective view of a child's toothbrush, generally indicated at 10. A children's fingertip toothbrush 10 may comprise a piece of elastomeric material 65 forming a nonogonal-shaped hollow tube 12 having a first, open end 15 and a second, closed end 20. The toothbrush 10 may be generally comprised of a first rigid portion generally indicated at 25, the first portion proximal to the first, open end 15, and a second flexible portion generally indicated at 30 proximal to the second, closed end 20. The first portion 25 may be configured to receive a middle phalange of an adult's finger and the second portion 30 may be configured to receive a distal phalange of an adult's finger.

Various sizes, including length and circumference, of the first portion and second portion are possible and can be readily ascertained by those with skill in the art. In some configurations, the toothbrush 10 may be offered in various sizes, as adults may have different sized fingers. For example, the toothbrush may have a small/medium size and a medium/large size. In one example, the small/medium size may have a length from about 3 centimeters to about 5 centimeters. In another example, a medium/large size may have a length from about 4 centimeters to about 6 centimeters.

The nonogonal-shape of hollow tube 12 may provide a better fit for the finger of the caregiver compared to a typical circular shape, with the nonogonal-shape being less prone to slip off the caregiver's finger when in the child's mouth. The nonogonal-shaped hollow tube may be formed by a piece of elastomeric material 65 (or outer elastomeric layer 65), and the outer elastomeric layer may have a thickness from about 25 millimeters to about 30 millimeters. The elastomeric layer 65 alone may offer some degree of protection for the caregiver's finger.

The rigid portion 25 of the toothbrush 10 may further comprise a rigid lining 35 within the elastomeric layer 65. Rigid lining 35 may have an inner face 40 and an outer face 45. Outer face 45 of the rigid lining 35 may be connected to the interior of the elastomeric layer 65 proximal to the first, rigid portion 25, thus lining the first, rigid portion on the interior of the nonogonal-shaped hollow tube 12. The rigid lining 35 may be formed of a substantially rigid plastic, such as polypropylene, acrylic, polycarbonate, acrylonitrile butadiene styrene, polyoxymethylene, polyethylene terephthalate, high density or ultra high density polyethylene, polyvinyl chloride, etc.

In some configurations, the rigid lining's inner face 40 may comprise a portion having a plurality of extensions 50 and depressions 55. The plurality of extensions 50 and depressions 55 may serve various functions. For example, if a child bites down firmly on a caregiver's finger, the extensions 50 and depressions 55 may serve to distribute the pressure from the bite over the finger, rather than on a single location. The extensions and depressions may also aid in keeping the toothbrush 10 in place on the caregiver's finger while in use. In other configurations, the rigid lining 35 may be substantially smooth. It will also be appreciated that the extensions 50 may be formed from another material. In other configurations, the extensions and depressions may not be present.

The second, flexible portion 30 may be comprised of an elastomer. In some configurations, the elastomer may have a thickness in the second portion of about 20 to about 30 millimeters, and may be comprised of an inner elastomer layer 60 and an outer elastomer layer 65. In other configurations, the second, flexible portion may be comprised of only the outer elastomer layer 65. The outer elastomer layer 65 may extend over the first portion and second portion such that the outside of the toothbrush 10 is comprised of an elastomer. In other configurations, the second, flexible portion 30 may be comprised of only the outer elastomer layer 65 and may have a thickness of about 10 to about 15 millimeters.

Figure 6:
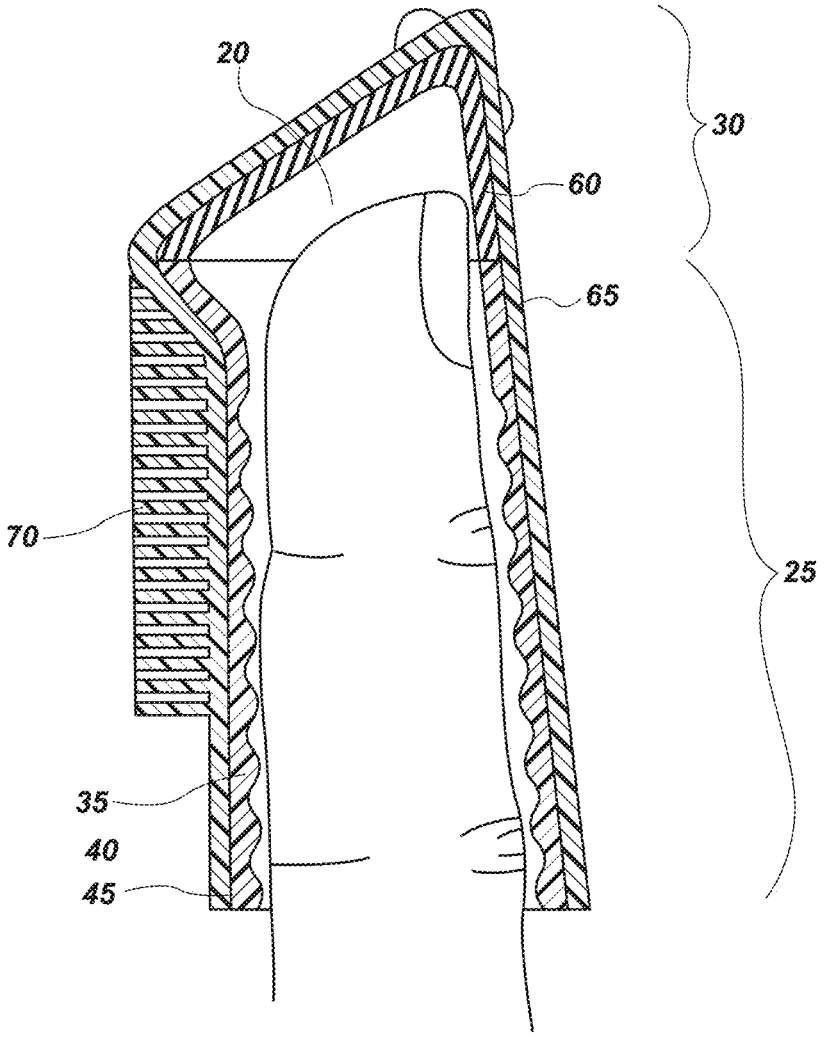
FIG. 6 is a cross-sectional view of the fingertip toothbrush of FIG. 5 shown in place on a caregiver's finger.

The outer elastomer layer 65 may also comprise a plurality of bristles 70 connected to the exterior of the nonogonal-shaped hollow tube proximal to the second flexible portion 30. In some configurations, the outer elastomer layer 65 and the plurality of bristles are formed integrally from a single mold. The elastomer may be any suitable elastomer known by those in the art, such as silicone or the like. FIG. 6 shows the fingertip toothbrush as it may be placed on a caregiver's fingertip. The first portion 25 may be configured to receive a middle phalange of an adult's finger and the second portion 30 may be configured to receive at least a portion of a distal phalange of an adult's finger.

According to another aspect, a method for forming a fingertip toothbrush is disclosed. The method may comprise the following steps, some of which may be performed at the same time, and which may not need to be performed in the steps taken. First, the rigid lining may be formed. Next, the outer elastomer layer may be formed by silicone injection molding.

According to another aspect, a method for forming a fingertip toothbrush is disclosed comprising these steps, taken in the order presented: first, forming the rigid lining, and second, injection molding silicone.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A fingertip toothbrush comprising:

an outer elastomeric layer forming a nonogonal-shaped hollow tube, the nonogonal-shaped hollow tube comprising a first, open end and a second, closed end, the nonogonal-shaped hollow tube having a first rigid portion proximal to the first, open end, and a second flexible portion proximal to the second, closed end, wherein the first rigid portion is configured to receive a portion of the distal phalange of a finger and the second flexible portion is configured to receive a distal end of the distal phalange of the finger;

wherein the nonogonal-shaped hollow tube comprises an interior and an exterior;

the first rigid portion comprising a rigid lining, the rigid lining having an inner face and an outer face, the inner face of the rigid lining having a surface comprised of a plurality of extensions and depressions, and the outer face of the rigid lining being connected to the interior of the nonogonal-shaped hollow tube proximal to the first rigid portion of the nonogonal-shaped hollow tube, and a plurality of bristles connected to the exterior of the nonogonal-shaped hollow tube proximal to the first rigid portion.

2. The fingertip toothbrush of claim 1, wherein the rigid lining is formed from a hard plastic.

3. The fingertip toothbrush of claim 2, wherein the rigid lining has a thickness of about 0.76 centimeters.

4. The fingertip toothbrush of claim 3, wherein the first rigid portion has a first diameter proximal to the first, open end and a second diameter proximal to the second, flexible portion.

5. The fingertip toothbrush of claim 4, wherein the second diameter is smaller than the first diameter.

6. The fingertip toothbrush of claim 4, wherein the second diameter is larger than the first diameter.

7. A fingertip toothbrush comprising:

an outer elastomeric layer forming hollow tube, the hollow tube comprising a first, open end and a second, closed end, the hollow tube having a first rigid portion proximal to the first, open end, and a second flexible portion proximal to the second, closed end, wherein the first rigid portion is configured to receive a middle phalange of a finger and the second flexible portion is configured to receive a distal phalange of the finger;

wherein the outer elastomeric layer comprises an interior and an exterior;

the first rigid portion comprising a rigid lining, the rigid lining having an inner face and an outer face, and the outer face of the rigid lining being connected to the interior of the outer elastomeric layer proximal to the first rigid portion, and a plurality of bristles connected to the exterior of the hollow tube proximal to the second flexible portion.

8. The fingertip toothbrush of claim 7, wherein the inner face of the rigid lining having a surface comprised of a plurality of extensions and depressions.

9. The fingertip toothbrush of claim 8, wherein the hollow tube comprises a nonogonal-shaped hollow tube.

* * * * *